US005750011A

United States Patent [19]

Ohmi et al.

[11] Patent Number: 5,750,011

[45] Date of Patent: May 12, 1998

[54] APPARATUS AND METHOD FOR PRODUCING GASEOUS IONS BY USE OF X-RAYS, AND VARIOUS APPARATUSES AND STRUCTURES USING THEM

[75] Inventors: Tadahiro Ohmi, 1-17-301, Komegabukuro 2-chome, Aoba-ku, Sendai-shi Miyaga-ken 980, Japan; Hitoshi Inaba, Tokyo; Tomoyuki Ikedo, Shizuoka-ken, both of Japan

[73] Assignees: Tadahiro Ohmi; Takasago Netsugaku Kogyo Kabushiki Kaisa; Hamamatsu Photonics Kabushiki Kaisha, all of, Japan

[21] Appl. No.: 387,712

[22] PCT Filed: Aug. 13, 1993

[86] PCT No.: PCT/JP93/01145

§ 371 Date: Mar. 22, 1995

§ 102(e) Date: Mar. 22, 1995

[87] PCT Pub. No.: WO94/05138

PCT Pub. Date: Mar. 3, 1994

[30] Foreign Application Priority Data

Aug. 14, 1992 [JP] Japan ..... 4-216807

[51] Int. Cl.[6] ..... H05F 3/06

[52] U.S. Cl. ..... 204/164; 361/213; 361/231

[58] Field of Search ..... 204/164; 361/213, 361/231

[56] References Cited

U.S. PATENT DOCUMENTS

| | | | |
|---|---|---|---|
| 4,827,371 | 5/1989 | Yost | 361/213 |
| 4,829,398 | 5/1989 | Wilson | 361/213 |
| 5,432,670 | 7/1995 | Batchelder et al. | 361/213 |

FOREIGN PATENT DOCUMENTS 2-68899 3/1990 Japan .

*Primary Examiner*—Kathryn L. Gorgos
*Assistant Examiner*—Kishor Mayekar
*Attorney, Agent, or Firm*—Baker & Daniels

[57] ABSTRACT

An apparatus and method for producing positive and negative ions and/or electrons in a gas of any atmosphere without producing dust, a method and structure for neutralizing a charged body in a short period of time and for completely preventing static electricity from being generated, and various apparatuses and structures, such as a conveyor, wet bench, and clean room, which use the neutralizing method and structure. The gaseous ion producing apparatus produces positive and negative ions and/or electrons in a gas by irradiating, with electromagnetic waves in a soft X-ray region, the gas under a high pressure, atmospheric pressure, or reduced pressure. In the neutralizing structure an X-ray unit is arranged at an appropriate place to apply the electromagnetic waves in a soft X-ray region to the atmospheric gas surrounding a charged body.

20 Claims, 16 Drawing Sheets

Wafer electrification potential and adhesion of small particle (≧0.5 μm)

Particle size dependency of small particle adhesion by electrostatic force

Target voltage dependency of electricity removing function [$N_2$, Air]

Target current dependency of electricity removing function

Atmospheric pressure dependency of electricity removing function

Application to a transfer system of wafer or liquid crystal substrate

Application to wet step

Application to spining dryer

Table Electrification of wafer in photolothography steps

| Step | Surface potential [V] |
|---|---|
| After wet process | -3000 or more |
| ↓ | |
| After blowing $N_2$ gas | -3000 or more |
| ↓ | |
| Before dry baking | +3000 or more |
| After dry baking | +3000 or more |
| ↓ | |
| After 5 minutes | +1700~+2300 |
| ↓ | |
| 3 minutes after HMDS process | +1500~+2400 |
| ↓ | |
| Before coating resist (using metal tweezer) | -15~+10 |
| After coating resist | -40 |
| ↓ | |
| Before pre-baking | +3000 or more |
| After pre-baking | +3000 or more |
| ↓ | |
| 5 minutes before air cooling | +2750~+3000 or more |
| 5 minutes after | +2800~+3000 |
| ↓ | |
| After setting exposure device (stage : metal) | +30~+35 |
| After photo-irradiation | +55 |
| ↓ | |
| After setting wafer carrier | -3000 or more |
| ↓ | |
| After processing | -1300 |
| ↓ | |
| After cleaning by ultra-pure water | -3000 or more |
| ↓ | |
| After blowing $N_2$ | -3000 or more |
| ↓ | |
| Before post baking | +500 |
| After post baking | +480 |
| ↓ | |
| After cooling for 5 minutes | -1000 |
| ↓ | |
| After removing resist | -3000 or more |
| ↓ | |
| After blowing N2 | -3000 or more |

FIG. 16

APPARATUS AND METHOD FOR PRODUCING GASEOUS IONS BY USE OF X-RAYS, AND VARIOUS APPARATUSES AND STRUCTURES USING THEM

This application is a national stage of PCT/JP93/01145, filed Aug. 13, 1993.

TECHNICAL FIELD

The present invention essentially relates to an apparatus and a method for generating positive and negative charges in a gas; further, relates to a method of neutralizing an electrified object and a structure of neutralizing electricity thereby and various apparatuses and structures using the same such as a transfer apparatus, a wet bench, a clean room and the like.

BACKGROUND ART

In a process of manufacturing an LSI and a liquid crystal for instance, electrification of a silicon wafer and a liquid crystal substrate becomes a big problem, and establishment of an electrification prevention technology is urgently needed. In view of such a background, this apparatus has been developed for forming gas molecule ions or electrons thereby neutralizing the electric charge of an electrified object. By using this apparatus, it is possible in a short time period to neutralize the surface charge of not only a silicon wafer and a liquid crystal substrate but also all the objects which are electrified in positive or negative polarity, and to prevent kinds of damage due to static electricity. In the following, an explanation will be given of an actual situation of electrification of a wafer, as an example, and problems caused thereby. Next, the problems in the current electrification prevention technology will be pointed out and an explanation will be given of the circumstances leading to the present invention.

(Electrification of Wafer)

A wafer is handled normally by fluoroethylene resin or quartz having an insulative property because of the necessity of preventing contamination by impurities and the need for chemical resistance. Therefore, a wafer is apt to be electrified at a very high potential. As an example of actual measurement, a result of measuring a potential of an electrified safer in photolithography steps is shown in a table of FIG. 16. As shown by these results, it is found that a wafer is electrified at a kV level.

(Problems due to electrification of wafer)

The wafer electrification brings about serious problems in the manufacturing process. The major ones are adhesion of floating particles by electrostatic force, destruction of an apparatus by discharge of static electricity, and a hazard in electron track which is problematic in electron beam exposure or the like. In the following, a simple explanation will be given of these hazards.

Adhesion of particles by electrostatic force

Five factors are related to the adhesion of floating particles to a wafer, which are gravity force, inertia force, electrostatic force, Brown diffusion, and thermal migration force, and the scale of influence differs with the particle size. The latter three factors are predominant with respect to particles having the size of 0.1 μm or less, and among them the influence of electrostatic force is extremely great.

FIG. 1 shows an actually-measured result of a relationship between a wafer potential and a rate of adhering of floating particles. The particle size in this case is 0.5 μm or more. It is apparent that the particle adhesion rate increases under the influence of electrostatic force.

Next, a theoretical calculation result is shown in FIG. 2 to investigate the influence of the electrostatic force in a case wherein the particle sizes are reduced further. Particle sizes for comparison by calculation are 2 μm, 0.5 μm and 0.1 μm, and the wafer potential is 1,000 V. In this calculation, only gravity force and electrostatic force are considered as adhesion forces, and a floating range of adhesion particles are calculated. The adhesion range of 2 μm particles is very narrow, and almost no particles adhere to the wafer.

However,, with a decrease in the particle size to 0.5 μm or 0.1 μm, the range of adhesion to the wafer rapidly increases. Further, when the particle size of the charged particles decreases, the influence of electrostatic force is very much enhanced in the adhesion. As stated above, in an environment wherein the particle size for an object of control in a clean room has become smaller and smaller, not only the prevention of generation of particles but also countermeasures for static electricity to minimize static electricity become very much important to minimize the adhesion.

Destruction of apparatus due to electrification

With thinning of insulation films and miniaturization of circuit patterns, the destruction of an apparatus due to electrification becomes a more and more serious issue. The destruction of an apparatus depends on a voltage and a current, and therefore, in the prevention thereof, not only the reduction in the potential of charged electricity but also the reduction in electrostatic energy should be considered.

Voltage in the destruction of an apparatus predominantly causes in an insulation breakdown of mainly an oxide insulation film or the like. In this case, the thinner the thickness of an oxide film, the lower the breakdown voltage naturally. Generally, the resistance against insulation breakdown of the oxide film is around 10 MV/cm.

On the other hand, current predominantly causes arising disconnection problems. This is caused by melting of a circuit by Joule's heat. The destruction of an apparatus by wafer electrification is significantly caused at a low electrification potential, more often than the problem of adhesion of floating particles due to electrostatic force. As in the prevention of electrification in processing wafers in an apparatus, the prevention of electrification in transferring wafers becomes very important.

(Conventional wafer electrification prevention technology)

As conventional wafer electrification prevention technology, there are following methods.

i) Ions are generated by the corona discharge method, whereby electric charge of an electrified wafer is neutralized.

ii) The charge of a wafer is neutralized by handling the wafer by a grounded conductive material (metal or conductive resin).

However, there are several drawbacks in these neutralizing methods, and so far as the drawbacks are not improved, these methods can not be employed in future as measures for neutralizing an electrified wafer.

Firstly, there are mainly four drawbacks in the corona discharge method i).

1) Generation of small particles from a discharge electrode.
2) Generation of residual potential due to a bias in ionic polarity.
3) Generation of inductive voltage due to high-tension discharge electrode.
4) Generation of ozone.

1) includes dust generation of an electrode material per se due to wear of a distal end of the discharge electrode caused by a sputtering operation of electrons and ions in the discharge operation, and the like, and dust generation of a substance which has been formed by solidifying impurities in the air in the discharge operation by a chemical reaction or the like that were adhered to and piled up on the surface of the electrode. The former dust generation has been solved by protecting the discharge electrode by a quartz glass that has been developed in recent years. However, the latter problem has not been solved yet.

2) is caused when the polarity of the voltage applied on the discharge electrode changes alternately in the positive and negative directions. When the polarity of the discharge electrode is positive, positive ions are supplied to an object for removing electricity, whereas, when the discharge electrode is negative, negative ions or electrons are supplied to it. Even after removing the electricity, a residual potential is caused since electric charges having such a biased polarity are supplied thereto. The nearer an ion generator to the object for removing electricity, the higher the residual electricity. Therefore, to alleviate the problem, they should be spaced apart from each other, and the ions should be transferred by a gas flow.

In recent years, a method has been developed which alleviates the residual potential by applying a direct current potential in the vicinity of an ion generating unit. However, this method can not be employed since, in the vicinity of an object for removing electricity, an inductive voltage, explained later, becomes a problem. The space is a major cause for retarding the neutralizing rate. In principle, the corona discharge method can not completely solve this problem.

3) The generation of the inductive voltage becomes a problem when the discharge electrode is proximate to the object for removing electricity. To prevent the hazard, the discharge unit and the object for removing electricity should be spaced apart from each other. As in the residual potential of 2), the neutralizing rate is retarded with the increase in the space.

4) In generating ozone, oxygen atom radicals formed by dissociating oxygen molecules are the major source of forming ozone. Such a dissociation phenomenon is accelerated by impact with low energy electrons of 10 eV or less or by light quantum absorption. In the corona discharge method, this phenomenon is observed in the corona region, and as a result, ozone is generated. Although the concentration of ozone depends on the structure of the discharge electrode, the applied voltage and the air flow amount, it reaches several tens of ppm at the maximum in an almost stagnant space. Since ozone has a very strong oxidation capacity, it not only accelerates the formation of a natural oxide film on the surface of a wafer but also accelerates deterioration of the surrounding macromolecular material.

Next, by ii), it is possible to completely prevent the electrification of a wafer. However, there is a great danger of a serious problem of contamination by impurities arising. Impurities not only in metals but also in fluoroethylene resin and the like to provide conductivity contaminate a wafer by contact abrasion with the wafer, which becomes a major cause for deteriorating electric characteristics. This is a problem more serious than static electricity. And the current state is that a wafer is handled by a resin having an insulative property to prevent the problem.

The present invention relates to an apparatus for simultaneously generating positive and negative charges which are capable of neutralizing the charge of an electrified object in a short time in any atmosphere, and also relates to a method and a structure of neutralizing electricity of the electrified object which is capable of completely preventing generation of static electricity without being accompanied by all the aforementioned drawbacks, and various apparatuses using the same.

BRIEF DESCRIPTION OF THE DRAWINGS

FIG. 16 illustrates a table showing a result of measurement of a wafer electrification potential in photolithography steps;

DISCLOSURE OF THE INVENTION

The first gist of the present invention exists in a gas ion generating apparatus employing an X-ray for generating positive and negative charges characterized in that by irradiating an electromagnetic wave in a soft X-ray region to air under an enhanced pressure, under an atmospheric pressure or under a reduced pressure, positive ions and negative ions and/or electrons are formed in the air.

The second gist of the present invention exists in a structure for neutralizing electricity of an electrified object characterized in that an X-ray unit is arranged at a pertinent location capable of irradiating an electromagnetic wave in a soft X-ray region to atmospheric air surrounding the electrified object.

The third gist of the present invention exists in a clean room characterized in that an X-ray unit is arranged in a clean room wherein clean air flows down from a ceiling to a floor such that an electromagnetic wave in a soft X-ray region can be irradiated in approximately parallel with a face of the ceiling.

The fourth gist of the present invention exists in a transfer apparatus having a transfer chamber for transferring an object to be processed to a processing apparatus, characterized in that an electromagnetic wave in a soft X-ray region can be irradiated to an atmospheric gas in the transfer chamber.

The fifth gist of the present invention exists in a living chamber characterized in that, in a living chamber of a building or a vehicle having an air introducing means for supplying air from outside to inside of the living chamber, a means is provided for forming positive ions and negative ions and/or electrons in the air by irradiating an electromagnetic wave in a soft X-ray region to the air.

The sixth gist of the present invention exists in a plant cultivating chamber characterized in that, in a plant cultivating chamber having an air introducing means for supplying air from outside to inside of the plant cultivating chamber, a means is provided for forming positive ions and negative ions and/or electrons in the air by irradiating an electromagnetic wave in a soft X-ray region to the air.

The seventh gist of the present invention exists in a method for generating positive and negative charges employing an X-ray irradiation characterized in that positive ions and negative ions and/or electrons are formed in air by irradiating an electromagnetic wave in a soft X-ray region to the air under an enhanced pressure, under an atmospheric pressure or under a reduced pressure.

The eighth gist of the present invention exists in a method of neutralizing electricity of an electrified object characterized in that positive ions and negative ions and/or electrons are formed by ionizing an atmospheric air by irradiating an electromagnetic wave in a soft X-ray region to an atmospheric air surrounding the electrified object, and a negative charge is neutralized by the formed positive ions whereas a positive charge is neutralized by negative ions and/or electrons.

Figure 1:
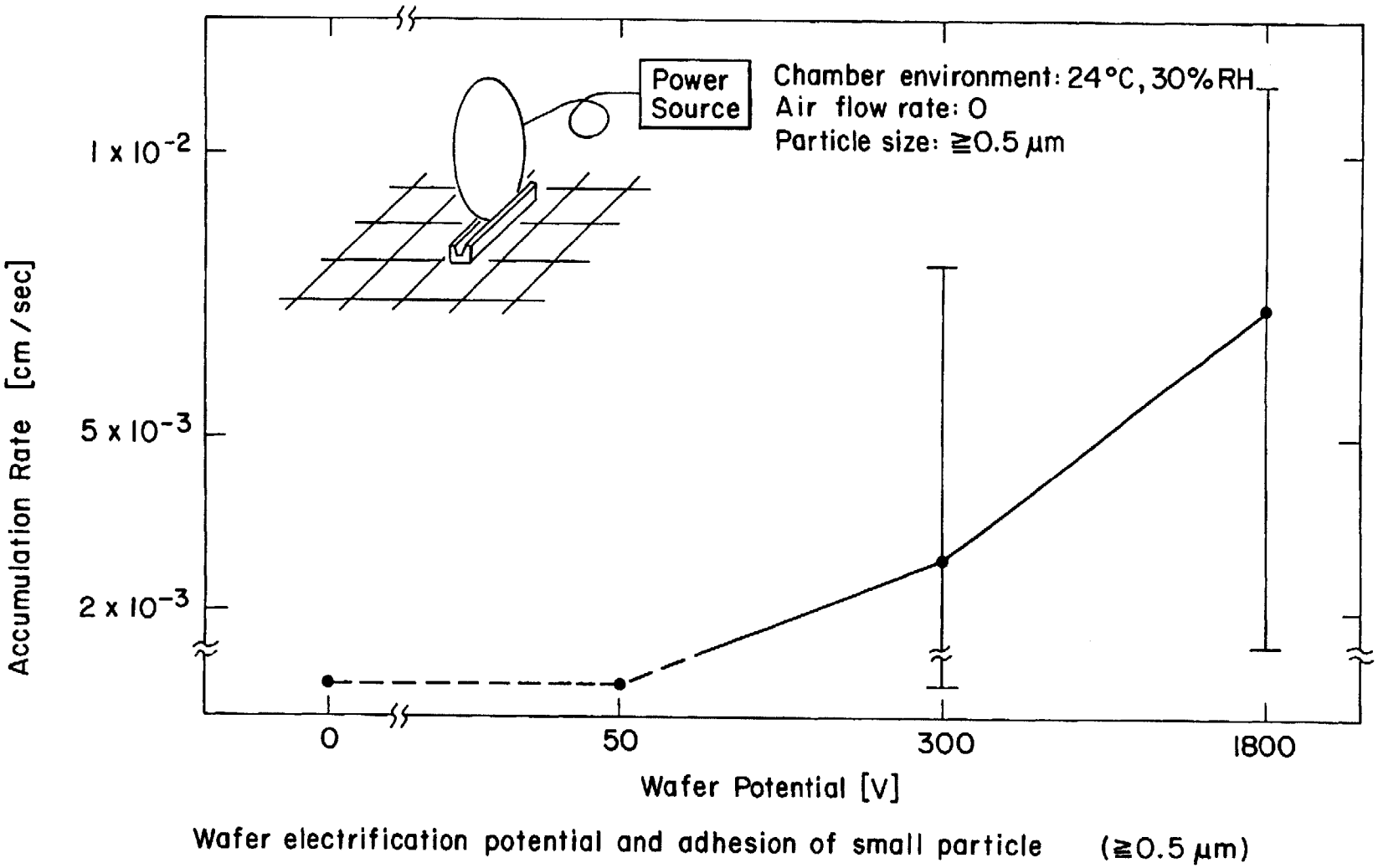
FIG. 1 is a graph showing a relationship between wafer potential and adhesion of particles.
Figure 2:
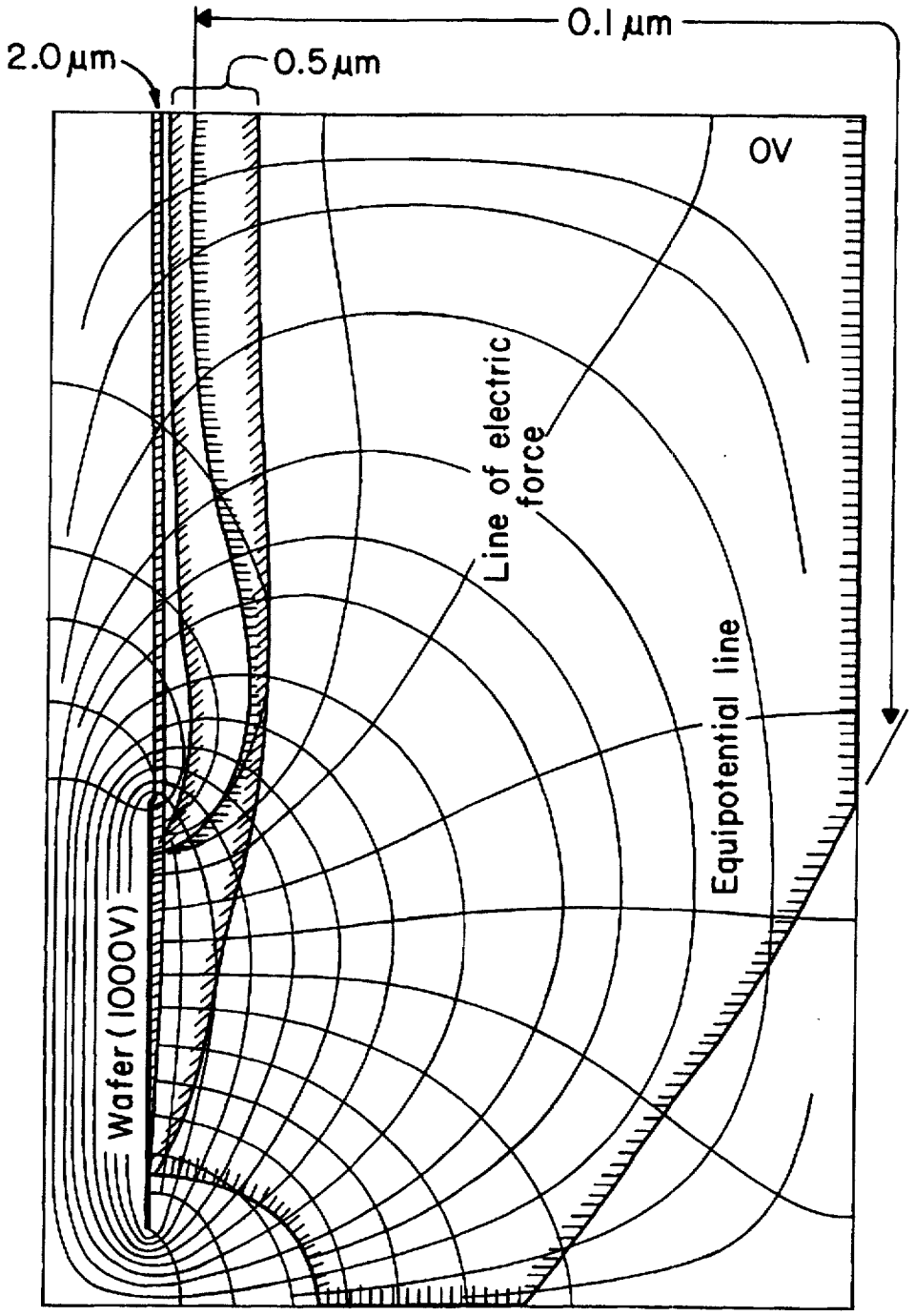
FIG. 2 is a graph showing particle size dependency of adhesion of particles by electrostatic force.
Figure 3:
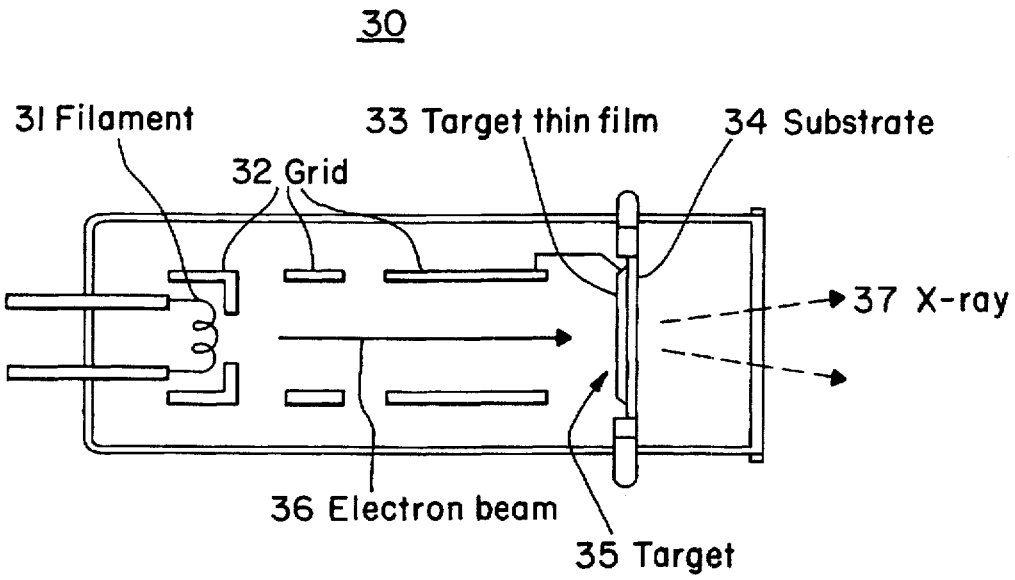
FIG. 3 is a side view showing an example of an X-ray unit employed in the present invention.

It is preferable to employ an X-ray unit shown for instance in FIG. 3 as an X-ray unit for generating an electromagnetic wave in a soft X-ray region. That is, it is preferable to employ a unit (for instance, Japanese Unexamined Patent Publication No. 297850/1990) which employs a target 35 formed with a thin target film made of a material for irradiating an X-ray by receiving electrons on an X-ray transmitting base 34, and wherein grid electrodes 32 are provided between an electron source (filament 31) and the target 35. This X-ray unit 30 is a so-called transmitting type wherein X-rays 37 are irradiated from the side opposite to the electron source since the target film 33 is thin. Therefore, it has advantages wherein the downsizing thereof is possible, and accordingly, it can be arranged at an arbitrary place. Further, since the grid electrodes 32 are provided between the electron source and the target 35, the control of the target current can be performed.

The electromagnetic wave in a soft X-ray region can simply be obtained by irradiating an electron beam having a predetermined energy to a specific substance (for instance, W: tungsten).

With respect to the wavelength of the generated X-ray, although depending on the target irradiated with electrons, it is preferable to employ a soft X-ray in a wavelength range of 1 Å through several hundred Å. Especially, a soft X-ray of 1 Å through several tens of Å is particularly preferable.

Further, as an electromagnetic wave in a soft X-ray region, it is preferable to employ an electromagnetic wave which is generated by accelerating an electron beam to 4 kV or more by making the target voltage (acceleration voltage) 4 kV or more aid impinging it on a target. Further, it is preferable to employ an electromagnetic wave which is generated by making the target current 60 μA or more.

Further, with respect to a gas (an atmospheric gas of an electrified body in the case of a structure for neutralizing electrification) to which an electromagnetic wave in a soft X-ray region is irradiated, the present invention is applicable to, for instance, nitrogen gas, or argon gas other than air. This gas need not be a flowing gas. For instance, in the case of neutralizing electricity of an electrified object, one of the characteristics of the present invention is that a sufficient neutralizing operation of an electrified object can be performed even without a flowing gas. Naturally, in the case of performing the irradiation of an electromagnetic wave in an X-ray region from an X-ray unit at a location apart from an electrified object, it is preferable to make the atmospheric gas to a gas flowing toward the electrified object. Further, a particularly significant effect can be obtained in the case of a pure nitrogen gas atmosphere having an impurity concentration of several ppb or less.

Further, the pressure of the atmospheric air should preferably be 1,000 Torr to 1 Torr and should more preferably be 1,000 Torr to 20 Torr.

The gas ion generating apparatus according to the present invention is preferably applicable to, for instance, a case with a purpose of neutralizing an electrified object. Further, it is applicable to a case with a purpose other than neutralization. In a case with a purpose of neutralization, the apparatus is preferably applicable to, for instance, a clean room, wafers, liquid crystal substrates and the like, a transfer apparatus, a wet processing apparatus, an ion implantation apparatus, a plasma apparatus, an ion etching apparatus, an electron beam apparatus, a film making apparatus, and apparatuses for handling other electrified objects and the like. On the other hand, this apparatus is applicable to living spaces such as a building, a vehicle (for instance, automobile, airplane, tramcar and the like.) and the like, or a plant cultivating chamber or the like, with various purposes.

Further, the inventors have discovered that it is preferable to make the concentration of formed ion pairs $10^4$ through $10^8$ ion pairs/cm$^3$.sec, and more preferable with $10^5$ through $10^8$ ion pairs/cm$^3$.sec. They also have discovered that the lilies of ions is 10 through 1,000 seconds in such a concentration. Accordingly, when ions are formed by the ion concentration of $10^3$ through $10^4$ ion pairs/cm$^3$.sec, and the distance between the position of a flowing gas irradiated with the electromagnetic wave in a soft X-ray region and an electrified object is determined by the following relationship, the neutralization of electricity of an electrified object can sufficiently be performed.

$$L/v<10 \text{ to } 1,000$$

L: distance from an irradiation position and an electrified object (m)

v: velocity of flowing gas (m/sec).

Further, the present invention can naturally be applied preferably to, for instance, a transfer apparatus, an ion implantation apparatus, a plasma reaction apparatus, an ion etching apparatus, an electron beam apparatus, a film making apparatus, and other apparatuses necessitating the neutralization of an electrified object as above.

In the present invention, positive ions and negative ions or electrons are formed by utilizing the ionization of gaseous molecules and atoms through the irradiation of an electromagnetic wave in a soft X-ray region.

Through this ionization method, all the problems of the aforementioned corona discharge ionization method or an ultraviolet ray irradiation ionization method can be solved.

In the corona discharge method, dust is caused at an end portion of a discharge electrode through the sputtering operation of discharge, however, in the present invention, positive and negative charges can be generated without generation of dust.

Further, in the corona discharge method, positive and negative space potentials are generated since positive and negative charges are supplied to the surrounding in conformity with polarities applied on the discharge electrode. As a result, a residual potential is generated in an object for removing electricity (electrified object). To lower the residual potential, the ion former had to be spaced apart from the object for removing electricity. By contrast, in the present invention, positive and negative charges having the same number are always formed around the object for removing the electricity, and therefore, after removing the electricity, the space potential is not biased, and a residual potential is not generated at an object for removing electricity. Accordingly, the X-ray unit can be proximate to the object for removing electricity up to any desired location, by which high electricity removing performance can be achieved.

Further, although a high-tension voltage is applied on the inside of the X-ray unit, the electric field does not come out to the outside since the inside is electrostatically shielded but a casing. Therefore, there is no inductive voltage caused by the discharge electrode which is a problem in the corona discharge method. Accordingly, there is no problem in making the X-ray unit proximate to the object for removing electricity up to any desired location.

A major characteristic of the present invention is in ionizing a gas without being accompanied with ozone even in using a gas containing oxygen as in air and the like. Accordingly, it is possible to solve the problems of the conventional method such as the oxidation of a semiconductor wafer or deterioration of macromolecular material.

In respect to the generation of ozone, the energy of a light quantum is in the order of several hundreds of eV through several KeV which is very high, and therefore gas molecules and atoms can effectively be ionized. As a result, the number of neutral oxygen atom radicals which are considered to contribute mostly to the formation of ozone is reduced, and the generation of ozone is suppressed.

Gaseous molecules and atoms are directly ionized by absorbing the electromagnetic wave in a soft X-ray region. The ionization energy of gas molecules and atoms is at least around 10 through 20 or so eV, which is one in several tens through several hundreds parts of a light quantum energy in a soft X-ray region. Accordingly, ionization of a molecule having a plurality of atoms and ionization of a molecule having divalency or more can be performed by one light quantum.

By irradiating a soft X-ray to a gas atmosphere surrounding an electrified object, ions and electrons having high concentration are formed whereby the neutralization of charge of tie electrified object can be performed. In this case, any gas can be provided with an approximately equivalent electricity removing performance irrespective of the kind of gas surrounding the electrified object. Further, the ionization of the gas can be performed in the vicinity of the electrified object, which is different from the neutralization of electricity by the corona discharge ionization method, and therefore, the formed ions and electrons can effectively be used for neutralization, and as a result the electricity removing function is greatly enhanced. Further, in comparison with a case wherein an ionized gas is transferred by piping or the like, the electricity removing function is enhanced by 100 through 1,000 times.

BEST MODE FOR CARRYING OUT THE PRESENT INVENTION

An explanation will be given of embodiments of the present invention as follows. Further, the present invention is not restricted to following embodiments and design changes, numerical value changes, circumventions and the like which a skilled person can easily perform are naturally included in the scope of the present invention.

(Embodiment 1)

An explanation will be given of an experiment of neutralizing electricity of an electrified wafer according to the present invention, while showing obtained data.

Figure 4:
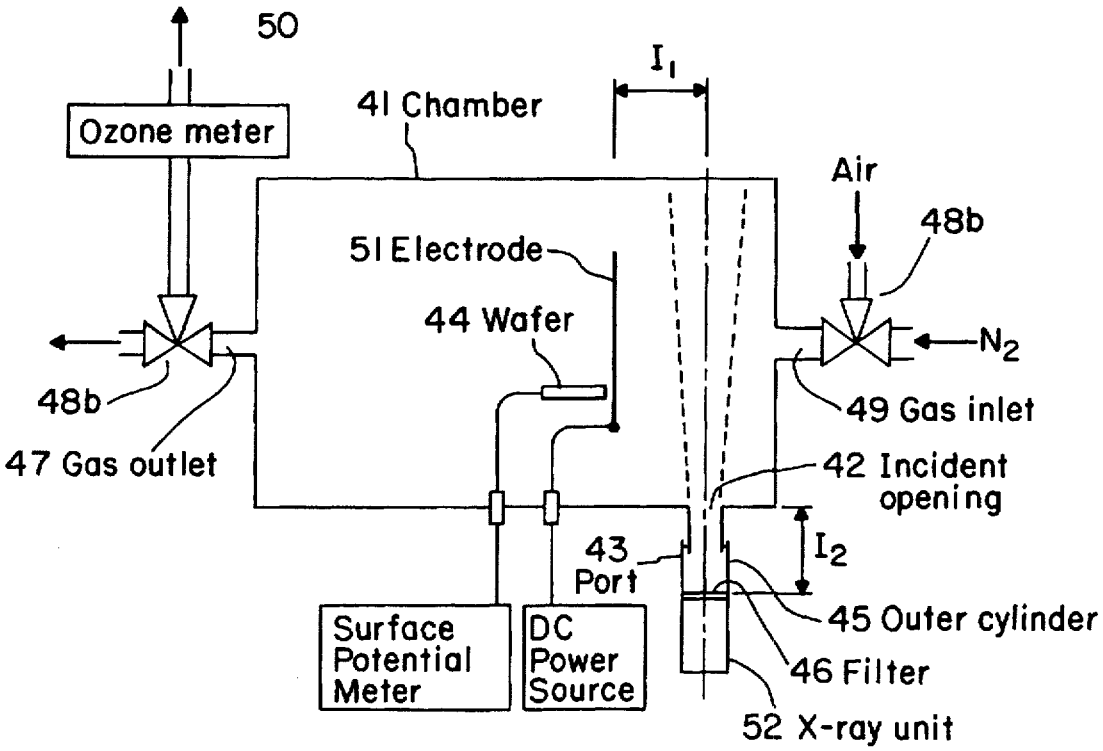
FIG. 4 is a conceptual view of an apparatus which is used for an experiment of neutralization.

The apparatus used for the experiment is shown in FIG. 4. An incident opening 42 is provided on a side wall of a SUS(stainless steel) chamber 41 such that a soft X-ray can be irradiated from outside into the chamber. The incident opening 42 is further provided with a port 43 having the diameter of 50 mm and the length $l_2$. The length $l_2$ of the port 43 is set to a length whereby an electrified object (wafer) 44 can not be seen from an end opening of the port 43 (that is, the wafer can not be seen from the end opening), whereby the direct incidence of the X-ray to the wafer 44 can be prevented. Further, in this example, the port 43 is provided with a double-cylinders structure, and an outer cylinder 45 is slidable. Accordingly, even when a distance of $l_1$ between the wafer 44 and the incident opening 44 changes by a change in the size of the wafer 44, and the like, the wafer 44 can not be seen from the end opening of the port by freely changing the length $l_2$ of the port 43 by sliding the outer cylinder 45.

Further, a filter 46 is attached to the end opening of the port 43 to separate the inside of the chamber 41 from the outside. An atmospheric gas, (for instance, $N_2$, Air, Ar) is introduced from a gas inlet 49 provided at one end (righthand side in the drawing) of the chamber 41. Further, in this example, a three-way valve **48*a* is provided at a gas inlet 49, whereby switching of the gas being introduced can be performed. Further, the other end (lefthand side in the drawing) of the chamber 41 is provided with a gas outlet 47. Also, the gas outlet 47 is provided with a three-way valve 48*b* of which one branch is connected to an ozone meter 50. The ozone concentration is monitored at the exhaust side by the ozone meter 50**.

To perform an evaluation experiment, an electrode 51 is provided in the vicinity of the wafer 44, by which a predetermined initial potential can be applied to the wafer 44 through a direct current power source. Further, a surface potential meter is connected to the wafer 44. The electricity removing function was evaluated by monitoring an attenuation time of the surface potential of the wafer 44 by the surface potential meter.

The specification of an X-ray unit 52 employed in the experiment was as follows.

Target material: W

Target voltage: 2–9.7 kV

Target current: 0–180 μA

The experiment was performed with respect to the following items by employing the apparatus shown in FIG. 4.

1) Target voltage dependency and target current dependency of electricity removing performance.

First, the target voltage dependency was checked under the following experimental conditions.

Electrostatic capacity of wafer: 10 pF

Atmospheric gas: Air, pure nitrogen (nitrogen having impurity concentration of several ppb or less)

Target voltage: 4–9.7 kV

Target current: 120 μA constant $l_1$: 11 cm $l_2$: 9 cm

The initial wafer potential was determined to be ±3 kV, a soft X-ray generated under the above conditions was irradiated on the atmospheric gas, and the time period until the wafer potential became ±0.3 kV was measured.

Figure 5:
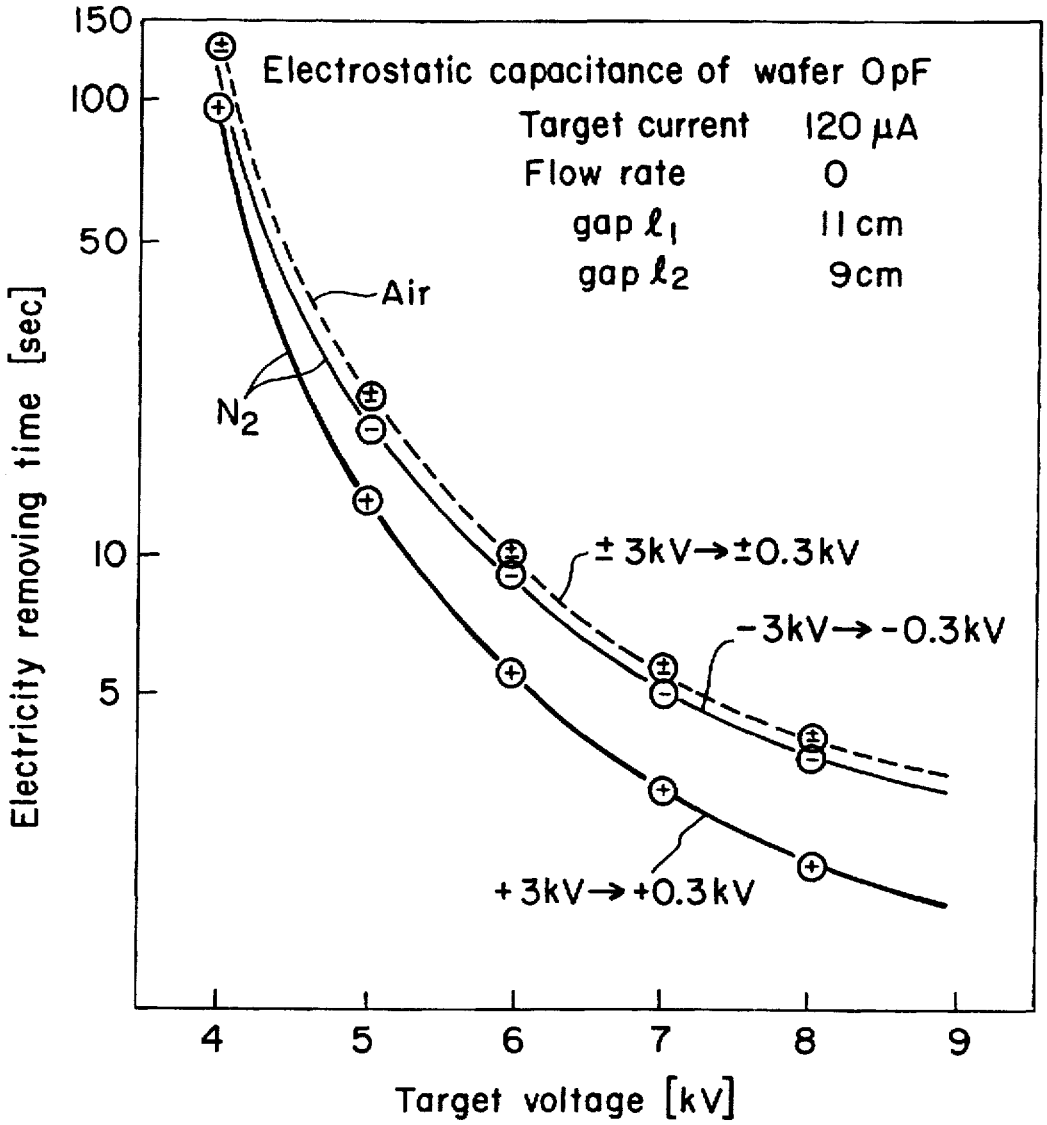
FIG. 5 is a graph showing the target voltage dependency of a charge removing function.

The results are shown in FIG. 5.

Next, the target current dependency was investigated by the following experimental conditions.

Wafer electrostatic capacity: 10 pF

Atmospheric gas: Air, pure nitrogen (nitrogen having impurity concentration of several ppb or less)

Target voltage: 8 kV

Target (current: Vary in a range of 30 through 180 μA $l_1$: 11 cm $l_2$: 9 cm

Further, the electricity removing function was evaluated by making the initial wafer potential to be ±3 kV, by radiating the soft X-ray generated under the above conditions to the atmospheric gas, and by measuring the time period whereby the wafer potential became ±0.3 kV.

Figure 6:
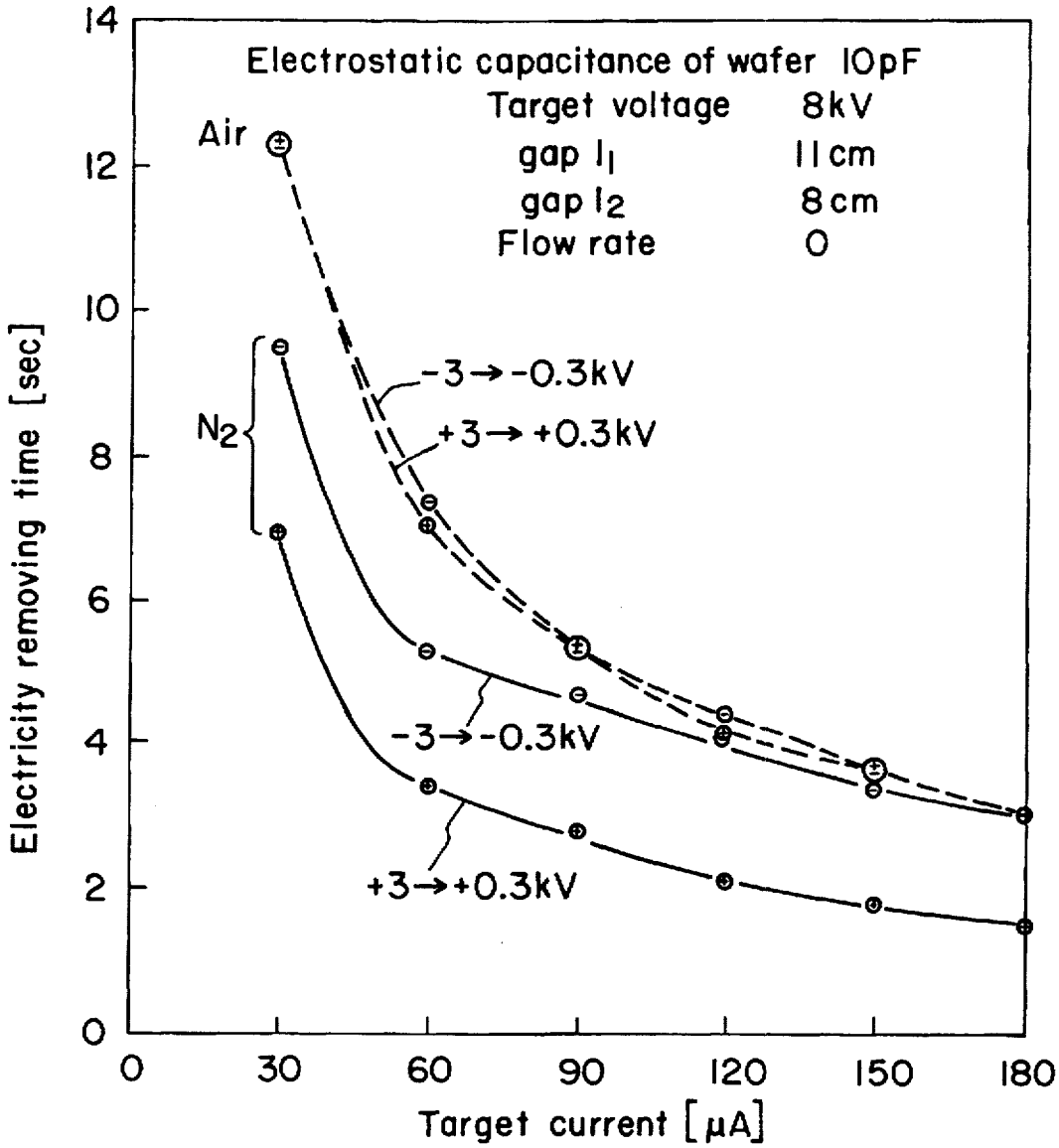
FIG. 6 is a graph showing the target current dependency of a charge removing function.

The results are shown in FIG. 6.

As shown in FIG. 5 and FIG. 6, it is found that the electricity removing time period of the electrified object considerably depend s on the target voltage and the target current. Especially, the former dependency is very large. When the target voltage is not larger than 4 kV, there is almost no electricity removing function, and the ionization rate of the gas is very low. In this case, when the target voltage is not less than 6 through 7 kV, the electricity removing of the electrified object can be performed in an extremely short time period.

Although the current dependency is small compared with the voltage dependency, it is preferable to make the target current 60 μA or more to perform the neutralization in a short time period.

By the way, both in FIG. 5 and FIG. 6, the electricity removing tendency is different between in air and in pure nitrogen (nitrogen having an impurity concentration of several ppb or less). In the air, with respect to both the positive and negative charges the electricity removing function remains the same; however, in pure nitrogen, the electricity removing function of the positive charge is higher. The difference is in a difference of an existence rate of a negative ion source. That is, in the air, comparatively stable negative ions are formed by letting oxygen, $CO_2$, $NO_x$, $SO_x$ and the like combine with electrons ionized front gas molecules. Accordingly, what neutralizes the electrified charge are positive and negative ions having an approximately equivalent mobility.

On the other hand, in pure nitrogen, there is almost no such negative ion source (ppb level or less), and therefore, many of the electrons ionized from gas molecules contribute directly to the neutralization of a positive charge without forming negative ions. The mobility of the electrons in an electric field is larger than that of the ions by several orders. Accordingly, the formed electrons can reach the electrified object in a very short time and the disappearance thereof by neutralization through rebonding with positive ions and diffusion is restrained, which contributes to the neutralization of the electrified object. As a result, the electricity removing rate of the positive charge is accelerated.

2) Dependency of electricity removing performance on material of an irradiation window.

The soft X-ray is absorbed very easily by substances, which is different from the hard X-ray. Accordingly, in electricity removing in a special atmosphere, it is possible that the electricity removing function is lowered in a case wherein the soft X-ray is irradiated through a filter window.

This was, confirmed by performing an experiment under the following conditions. The electricity removing function was compared among a case of no filter, a case of a polyimide film having a high transmittance which is comparatively stable with respect to radiation, and a case of synthesized quartz having a thickness of 2 mm.

Electrostatic capacitance of wafer: 10 pF

Atmospheric gas: Air

Wafer potential: ±300 V→±30 V

Target voltage: 8 kV

Target current: 120 μA $l_1$: 11 cm $l_2$: 9 cm

End opening of port: i) no filter ii) polyimide film of 0.12 mm installed.

iii) Synthetic quartz of 2 mm installed.

The measurement results are as follows.

| | | Electricity removing time for +300V —> +30V | Electricity removing time for −300V —> −30V |
|---|---|---|---|
| i) | No filter | 1.06 (1) | 1.21 (1) |
| ii) | Polyimide film of 0.12 mm | 1.29 (0.82) | 1.48 (0.82) |
| iii) | Synthesized quartz of 2 mm | — | — |

(Unit is sec/10 pF, number in parenthesis is the ratio of electricity removing time which is 1 for no filter)

The electricity removing function is comparatively good in the case of a filter made of polyimide film, and the electricity removing function is 82% of that of no filter. By contrast, in case of the synthesized quartz window, the electricity removing effect is completely lost, and it was found that the soft X-ray was absorbed almost 100%.

From this result, it is preferable to use a filter made of a material such as polyimide which is comparatively transparent with respect to radiation, in case of irradiating the soft x-ray through the filter in such a special atmosphere, for instance, in a closed system wherein the atmospheric gas is in an air-tight state.

3) Dependency of electricity removing function on pressure of an atmospheric gas.

Next, the dependency of the electricity removing function on the atmospheric pressure was investigated. The experimental conditions are as follows.

Electrostatic capacity of wafer: 10 pF

Atmospheric gas: Air

Target voltage: 8 kV

Target current: 120 μA $l_1$: 11 cm $l_2$: 9 cm

Further, the electricity removing function was evaluated by irradiating the soft X-ray generated under the above conditions wherein the initial wafer potential was ±300 V, on the atmospheric gas, and by measuring a time period until the wafer potential reached ±30 V.

Figure 7:
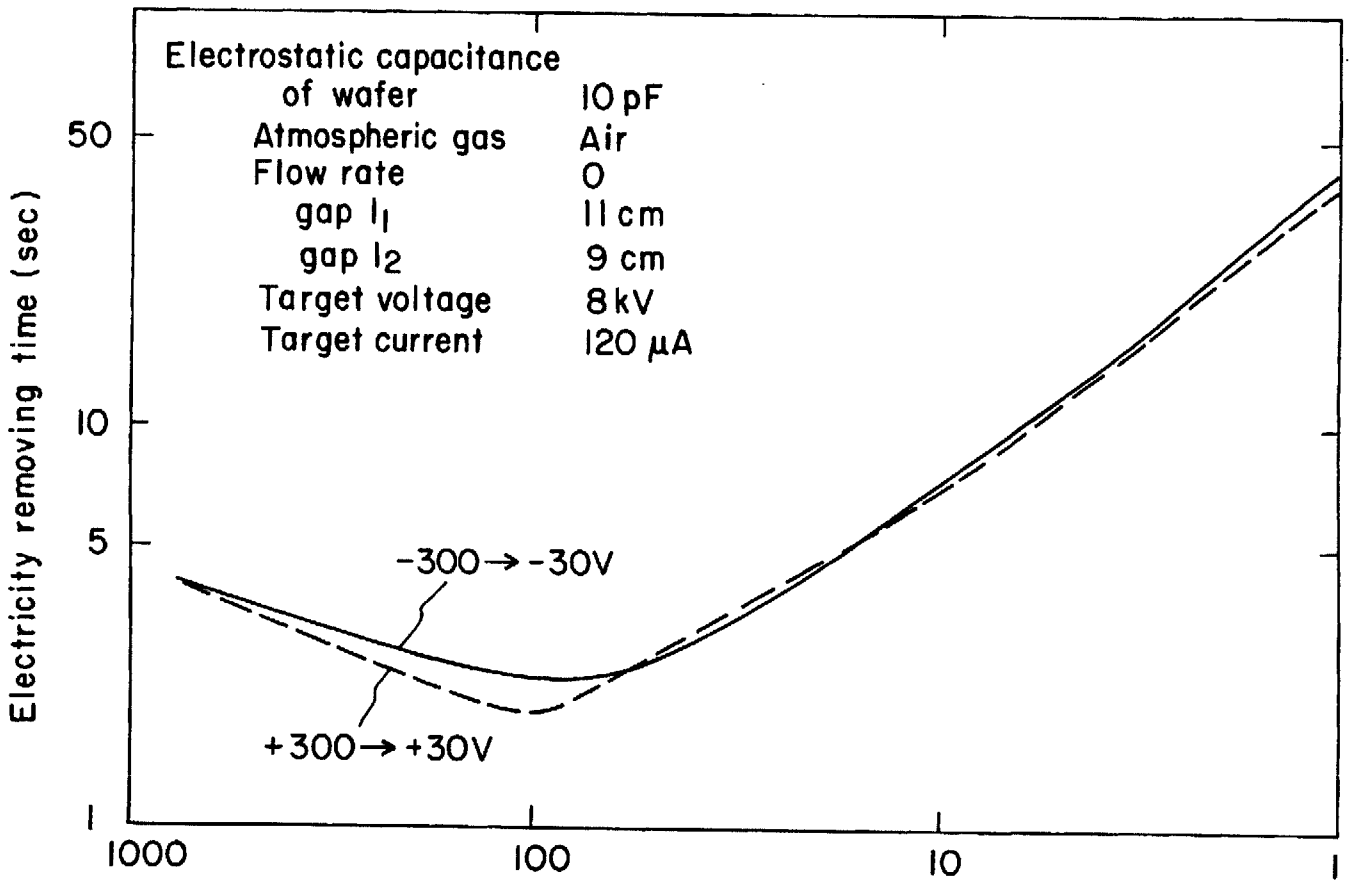
FIG. 7 is a graph showing the atmospheric pressure dependency of a charge removing function.

The results are shown in FIG. 7.

The electricity removing function clearly changes depending on the atmospheric pressure. The function is gradually improved up to 100 Torr, wherein the electricity removing can be performed approximately twice as fast at the maximum. However, thereafter, it is more and more retarded, at approximately 20 Torr, it is about the same as that at atmospheric pressure, and at 1 Torr, it is retarded by 10 times. From this result, it is found that the electricity removing is possible under a reduced pressure up to around 1 Torr, however, thereafter, the electricity removing time is very much prolonged, which is not so effective.

4) Ozone concentration of electricity removing atmosphere

An experiment was carried out concerning the ozone generation which is often problematic in the electricity removing in air.

The experimental conditions are as follows.

Atmospheric gas: Air

Target voltage: 9.7 kV

Target current: 190 μA $l_2$: 9 cm

The amount of generation of ozone was measured by the ozone meter 50 in FIG. 4. As shown in FIG. 4, the ozone concentration was measured by the ozone meter 50 by drawing the gas in the chamber 41 by a suction amount of 2 l/min. Further, the measurement was carried out 30 minutes after irradiating an electromagnetic wave in the X-ray region.

The result is shown below. The concentration of background (BG) and the ozone amount in case of ultraviolet ray irradiation (UV irradiation) are also shown for comparison.

EMBODIMENT: 8–10 ppb

B.G.: 8–10 ppb

UV irradiation: 20 ppm (after 30 minutes)

As a result of measurement, there was no increase in the ozone concentration even in irradiating the soft X-ray, by which the generated concentration was verified to be the ppb level or less.

By contrast, in case of the ultraviolet ray irradiation performed for comparison, the ozone concentration was increased up to 20 ppm (about 2,000 times the B.G. value).

As stated above, the static electricity neutralizing function by the soft X-ray is very excellent. It is possible to form ion pairs having high concentration without being accompanied by the generation of ozone, and as a result, the charge of an electrified object can be neutralized in a short time period. Further, a shield measure is very easy wherein it is not irradiated on a human body, since the attenuation thereof is very fast.

Further, to more concentrate a radiation beam from a soft X-ray lamp and form an approximately parallel ray, it is effective to provide a shield plate (preferably a shield plate capable of totally reflecting an X-ray) on the irradiation unit.

(Embodiment 2)

Figure 8:
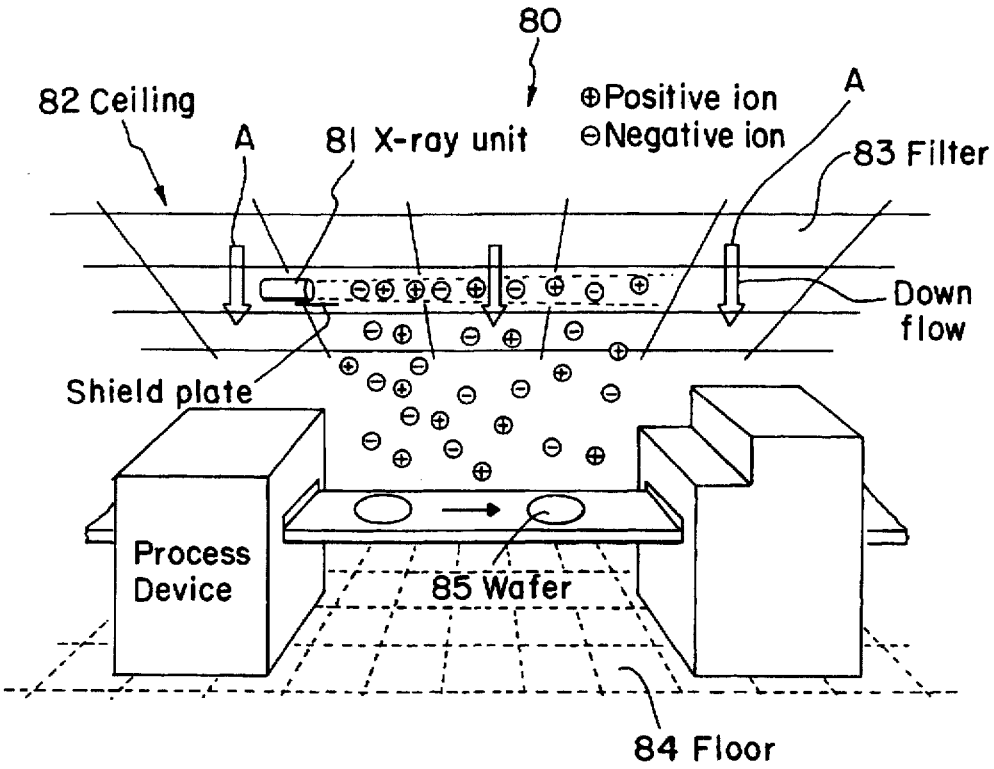
FIG. 8 is a perspective view of a clean room according to an embodiment of the invention.

An embodiment is shown in FIG. 8 in which an X-ray unit 81 is installed in a clean room 80.

In this, embodiment, the X-ray unit 81 is attached to a ceiling 82 so that a soft X-ray is irradiated approximately in parallel with the ceiling face of the clean room 80. The soft X-ray is irradiated approximately in parallel with the ceiling face to prevent a human body, or wafers (or liquid crystal substrates) 85 from being irradiated with the X-ray.

Further, a filter 83 is installed to the ceiling 82 for removing dust, and a so-called downflow air A is generated which flows from the ceiling 82 to a floor 84. Further, the X-ray emitted from the X-ray unit 81 is irradiated on the upstream portion of the air flow, and therefore, ions and electrons formed by the X-ray irradiation are transferred the wafer 85 at the downstream side by the air flow, and neutralize electricity of the wafer 85.

In this embodiment, the X-ray unit 81 is attached on the ceiling 82. However, the attachment is not limited to the ceiling 82 so far as the attached unit is at a location wherein the irradiation to a human body or the wafer 85 in the clean room 80 is avoided.

(Embodiment 3)

Figure 9:
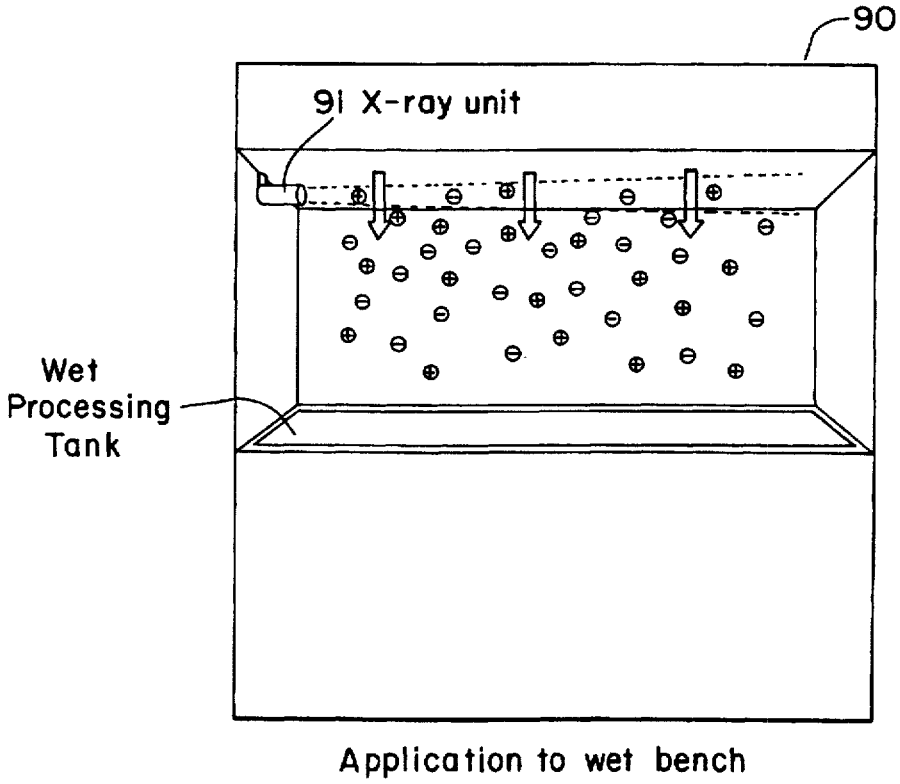
FIG. 9 is a perspective view of a wet bench concerning the example.

FIG. 9 shows an example wherein an X-ray unit 91 is installed to a wet bench 90.

Figure 10:
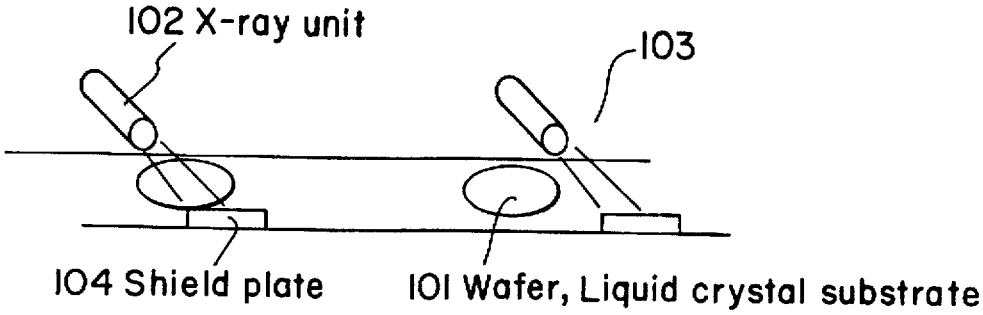
FIG. 10 is a conceptual view showing a transfer system of wafers and liquid crystal substrates concerning the example.

On the other hand, FIG. 10 shows an example wherein an X-ray unit 102 is installed at an open transfer apparatus of wafers or liquid crystal substrates 101. In a transfer apparatus 103 shown in FIG. 10, the X-ray unit 102 is located as near to the wafer 101 as possible, and a shield plate 104 is installed to shield the X-ray to avoid the bombardment to a human body.

(Embodiment 4)

Figure 11:
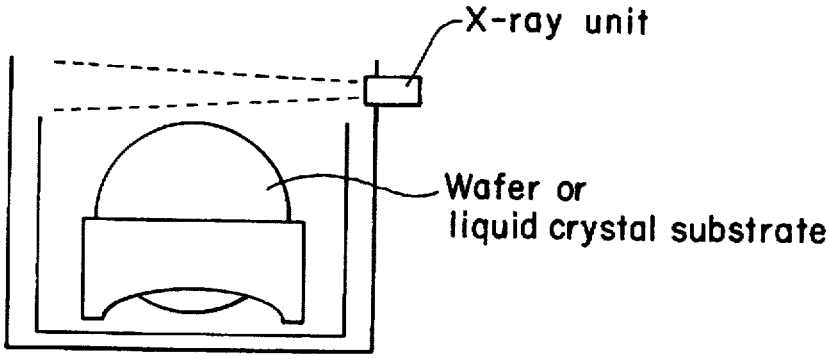
FIG. 11 is a perspective view of the wet bench concerning the example.
Figure 12:
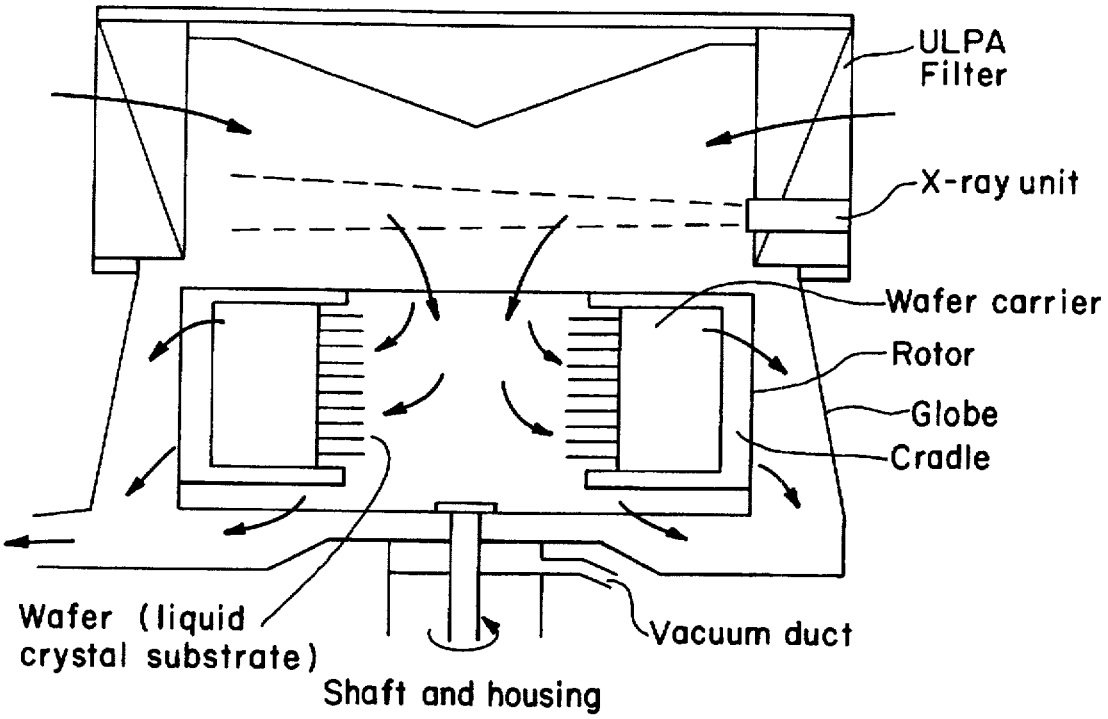
FIG. 12 is a perspective view of a spinning dryer concerning the example.

FIG. 11 shows an example of application to electricity removing in a wet step, and FIG. 12 shows an example of application to electricity removing in drying by a spinning dryer, respectively.

Figure 13:
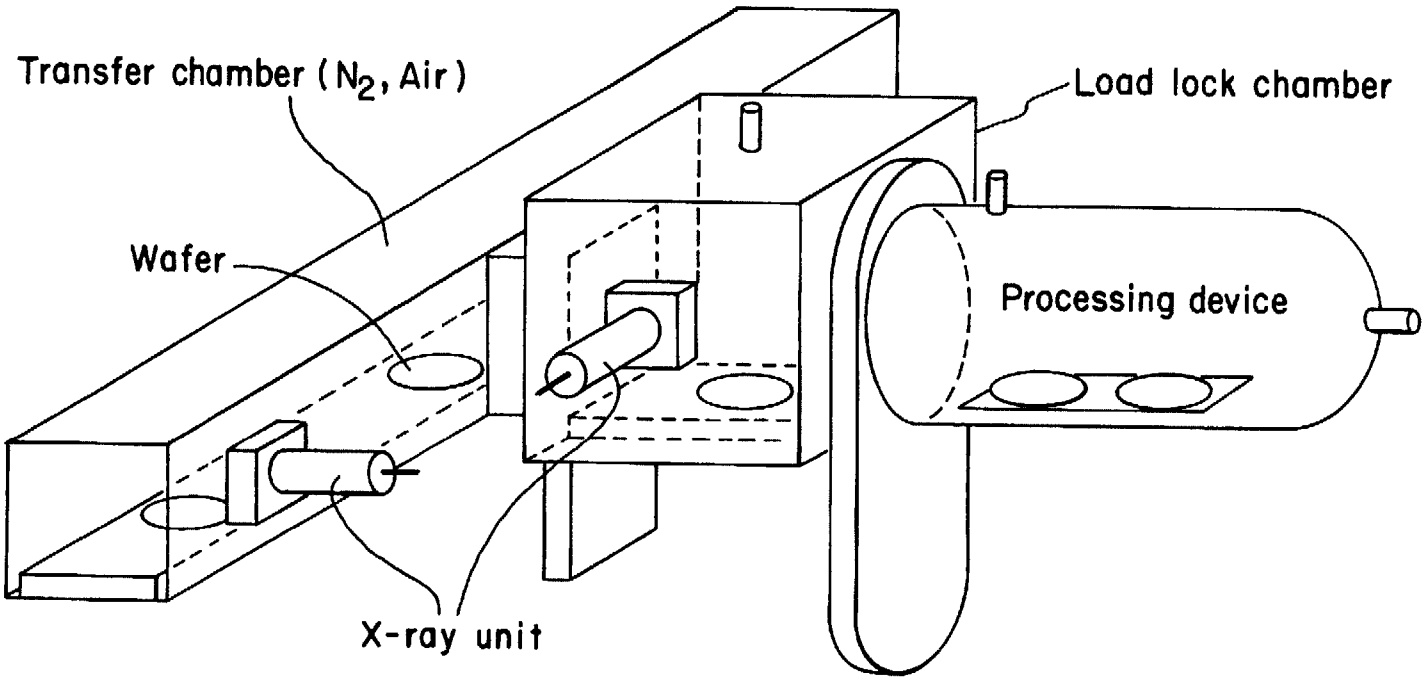
FIG. 13 is a perspective view of a closed transfer system and the inside of a manufacturing apparatus concerning the example.

FIG. 13 shows an example wherein the invention is applied on a closed transfer system. In this example, nitrogen gas (nitrogen gas having impurity concentration of several ppb or less in case of preventing surface oxidation of wafer) or air having the moisture concentration of several ppb is jetted from the lower side of the transfer chamber thereby carrying out a floating transfer of wafers. The X-ray units are provided on the side face in respect of the transfer direction. Further, the transfer chamber may be formed by a material that is transparent with respect to the soft X-ray, for instance, polyimide, and the soft X-ray may be irradiated to the atmospheric gas in the transfer chamber through polyimide.

Further, to prevent the surface oxidation of wafers, a trial has been performed wherein the transfer chamber is constructed by a stainless steel having a passive state film formed by thermal oxidation on its face, and nitrogen gas having impurity concentration of several ppb or less is employed as a gas for transfer. Further, when a stainless steel formed with a passive state film wherein Cr/Fe (in atomic ratio) is 1 or more, on its surface, is employed, it is more preferable since emittance of moisture from surface can be prevented.

Further, it is possible to irradiate the soft X-ray to the transfer gas (the transfer gas is the atmospheric gas) in a transfer clamber by forming the port shown in FIG. 4 on the side face of the transfer chamber, and irradiating the soft X-ray to tie atmospheric gas (nitrogen gas for transfer become the atmospheric gas in the transfer chamber through the opening of the port). Further, the length of the port ($l_2$ in FIG. 4) has a dimension whereby wafers in the transfer chamber can not be viewed from the end opening of the port (that is, wafers can not be seen from the end opening). This dimension changes with the diameter of wafer, the distance between the X-ray irradiation opening and wafers ($l_1$ in FIG. 4) and the like, and therefore, a structure is provided whereby the length of port is changeable.

The transfer apparatus in this example is a closed system, and therefore, the end opening of the port is formed with polyimide.

(Embodiment 5)

Figure 14:
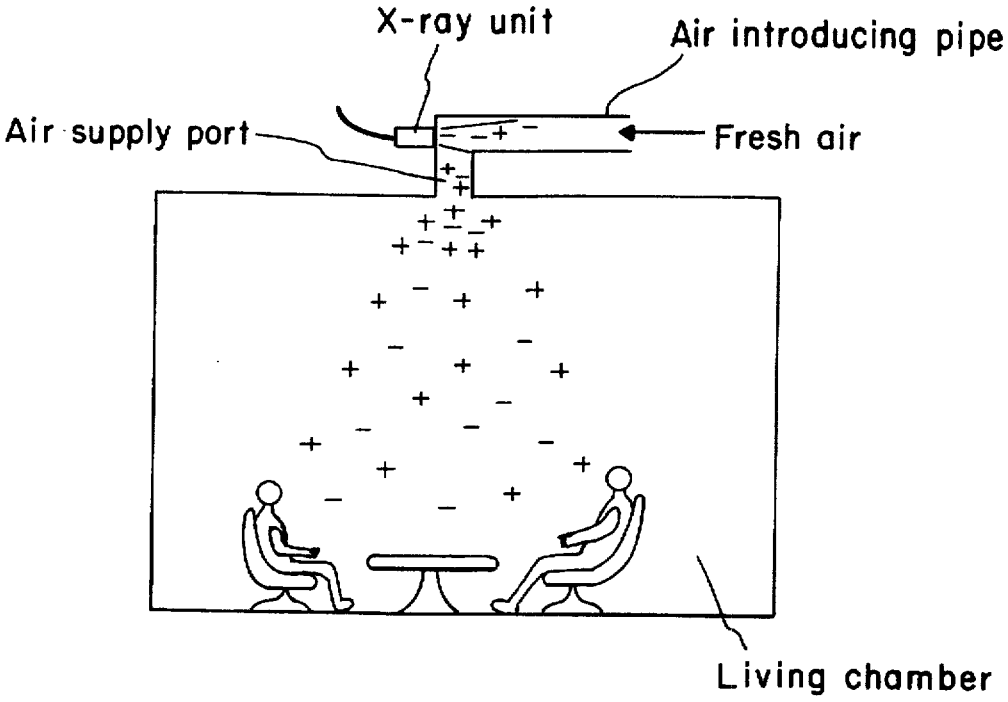
FIG. 14 is a conceptual view of a living space showing an example with respect to claim 15.

FIG. 14 shows an embodiment concerning claim 15. That is, FIG. 14 shows a living chamber in a building.

In this embodiment, an air introducing type is installed on the ceiling of the living chamber, and air sent from outside through this air supply pipe is introduced to the inside of the living chamber through a supply port of the air supply pipe.

Further, an X-ray unit is installed in the air supply pipe, and an opening is provided on the air supply pipe, through which the soft X-ray from the X-ray unit is irradiated to air flowing in the air supply pipe. Further, the air supply pipe may naturally be constructed by a material that it transparent with respect to the soft X-ray such as polyimide, without providing the opening.

When the soft X-ray is irradiated, positive ions and negative ions and/or electrons are formed in the air, and the air containing the positive ions and negative ions and/or electrons are transferred to the inside of the living chamber by riding on the air flow.

A living chamber of approximate 5 tsubo (1 tsubo is approximately 3.3 $m^2$) was formed, and the X-ray unit was installed in the construction shown in FIG. 14, and a test was performed with respect to a case (Embodiment) wherein the soft X-ray was irradiated and a case (Comparative Example) wherein was not irradiated.

The number of panelers was 20 and the evaluation was performed by their feeling.

The number of persons who answered that the inside of the chamber was fresher in case of irradiating the X-ray than in case of not irradiating the X-ray, was 15. The number of persons who answered that there was no difference between the case of irradiating the X-ray and the case of not irradiating the X-ray, was 5.

When a Geiger counter was provided on a table in FIG. 14, and the amount of bombardment of the X-ray was measured. As a result, the number of counting remained the same both in case of irradiating the X-ray and in case of not irradiating the X-ray.

(Embodiment 6)

Figure 15:
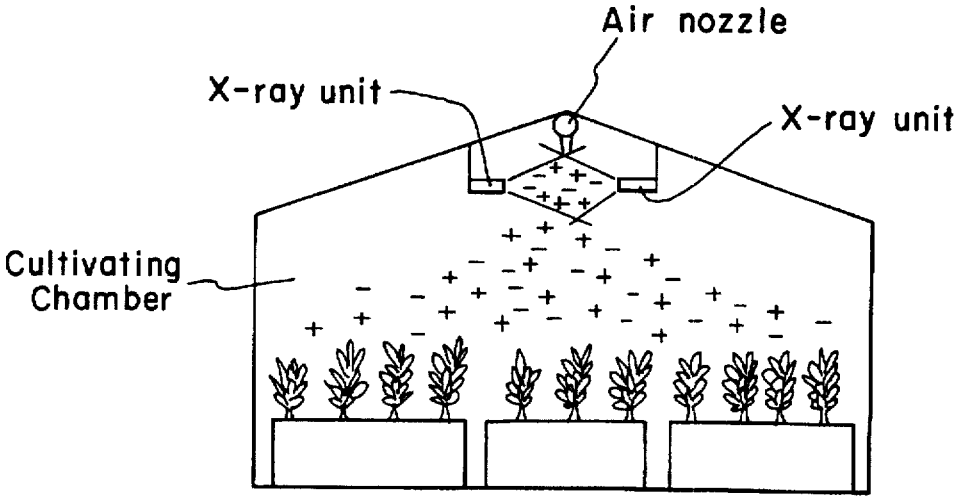
FIG. 15 is a conceptual view of a plant cultivating chamber showing an example with respect to claim 16.

An embodiment concerning claim 16 is shown in FIG. 15. That is, in FIG. 15, a cultivating chamber of plants (flower, vegetable and the like) is shown.

The irradiation of the soft X-ray was performed for a week, though days and nights in the construction of FIG. 15. When the color of leaves of flower was observed after one week, green color was shown which looked fresher than in case of not irradiating the soft X-ray.

Further, the installation of the X-ray unit may naturally be performed as shown in FIG. 14.

(Embodiment 7)

In this embodiment, electrification caused in transferring and cleaning glass substrates in a liquid crystal manufacturing apparatus, was removed by using the invented and a conventional electricity removing apparatuses and the results were compared.

Figure 17:
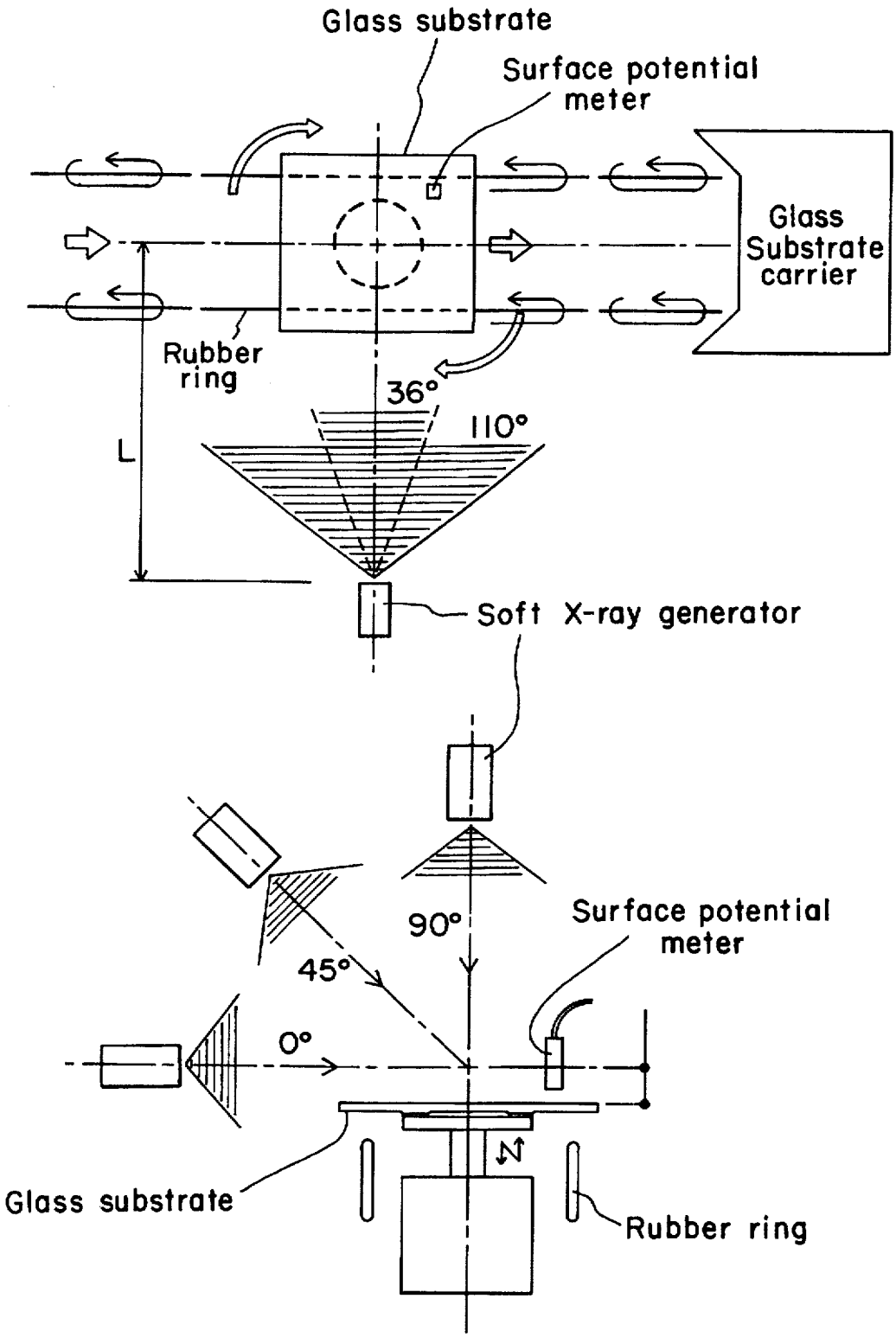
FIG. 17 is a conceptual view showing a method of removing electricity in transferring glass substrates.

FIG. 17 shows behavior of electricity removing performed in a transfer system of glass substrates. The glass substrate was accommodated in a carrier on the righthand side after once positioning it on a circular stage transferred from the lefthand side by a gummy ring. In this embodiment, the electricity removing was performed at the positioning unit, and the electricity removing characteristic was measured with an irradiation angle toward the substrate as shown in FIG. 17. Further, the measurement was performed under the same conditions also with respect to a blower type ionizer using the corona charge method, as a conventional electricity removing apparatus. The result of measurement is shown in FIG. 18.

Figure 18C:
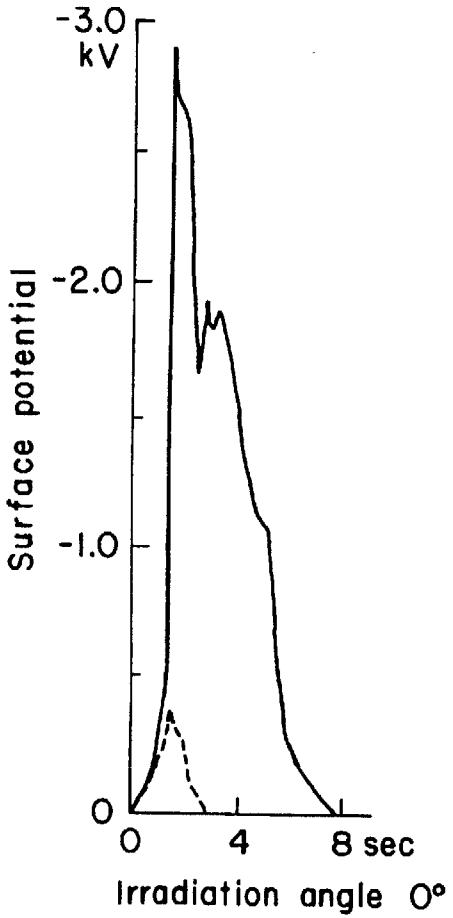
FIG. 18 is a graph showing a change of a surface potential of a glass substrate.
Figure 18B:
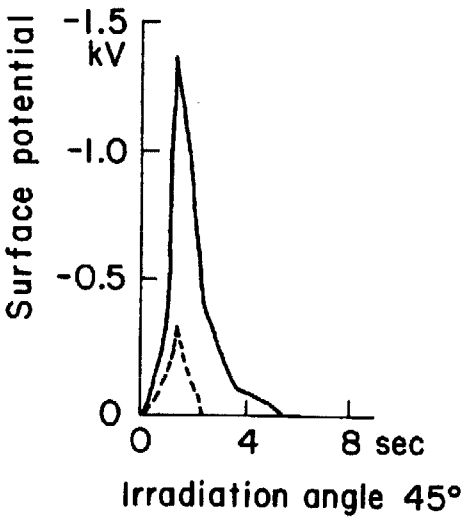
Figure 18A:
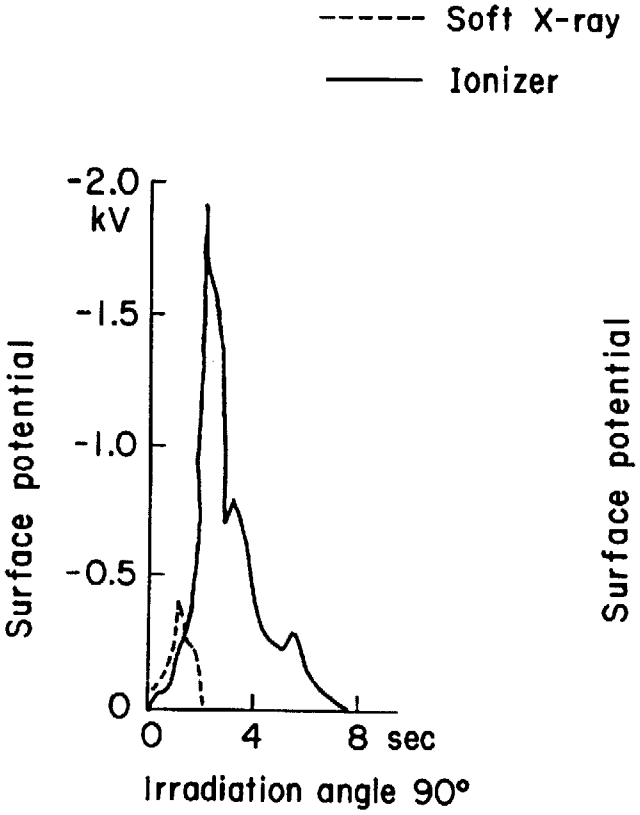

In FIG. 18, the ordinate denotes the electrification potential and the abscissa denotes an elapse time. The dotted line denotes the electricity removing characteristic by the soft X-ray, and the bold line denotes it by the ionizer. The electrification potential with no electricity removing shows a value always exceeding −3.3 kV which is the limit of the surface potential meter. In case of removing electricity by the soft X-ray of this embodiment, after starting the electricity removing, the peak potential was −0.4 kV at maximum, and the electricity removing time period until 0 V was only around 2 seconds. Further, it was found that the change of the electricity removing function by the irradiation angle was not recognized at all. On the other hand, in case of using the conventional ionizer, the electricity removing function considerably depends on the irradiation angle, and that the electricity removing function was much interior to that of the embodiment of the invention. For instance, there was a case wherein the peak potential reached −3 kV, and the time elapsed for at least 5 seconds or more.

Figure 19:
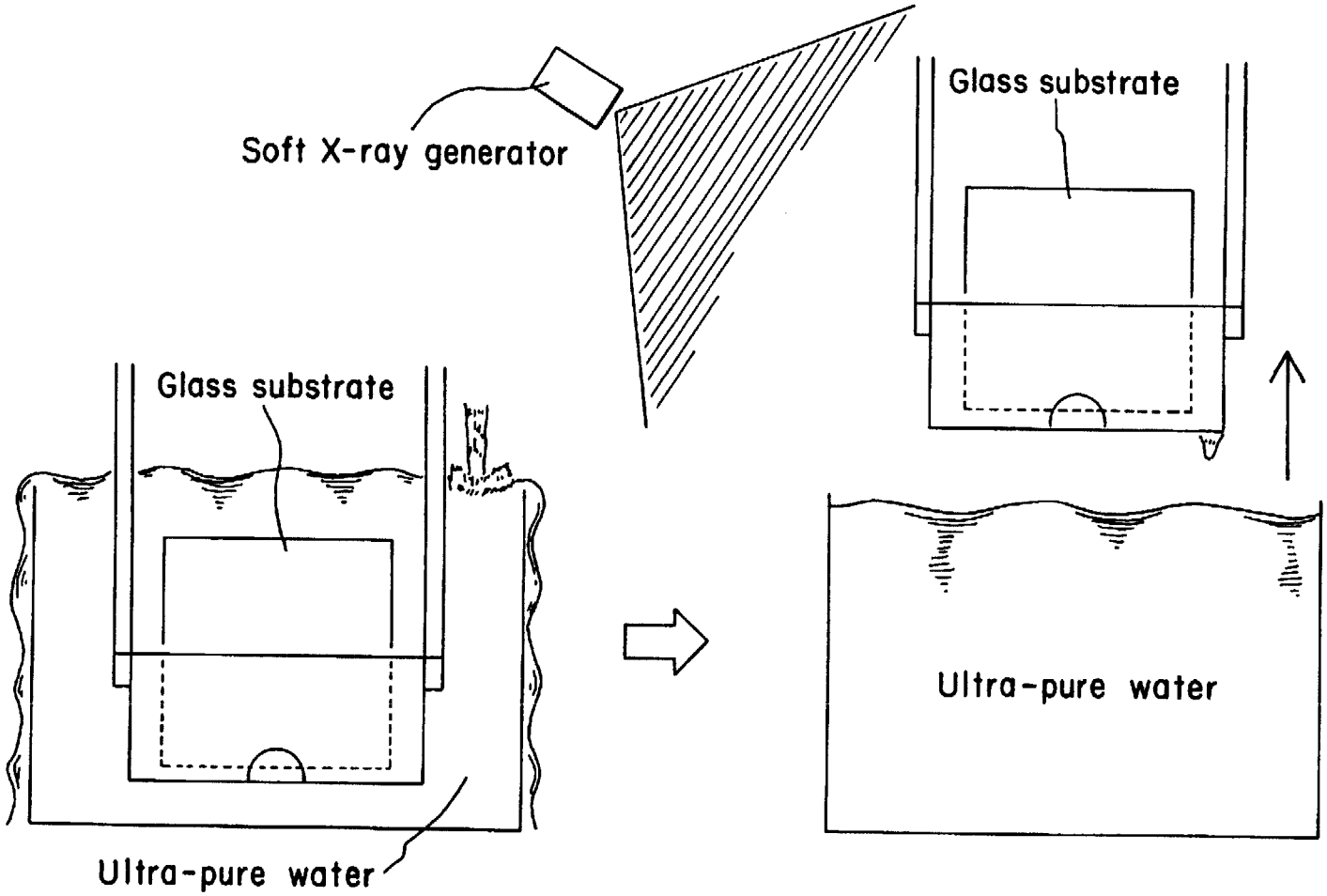
FIG. 19 is a conceptual diagram showing a method of removing electricity in pulling up a glass substrate.
Figure 20:
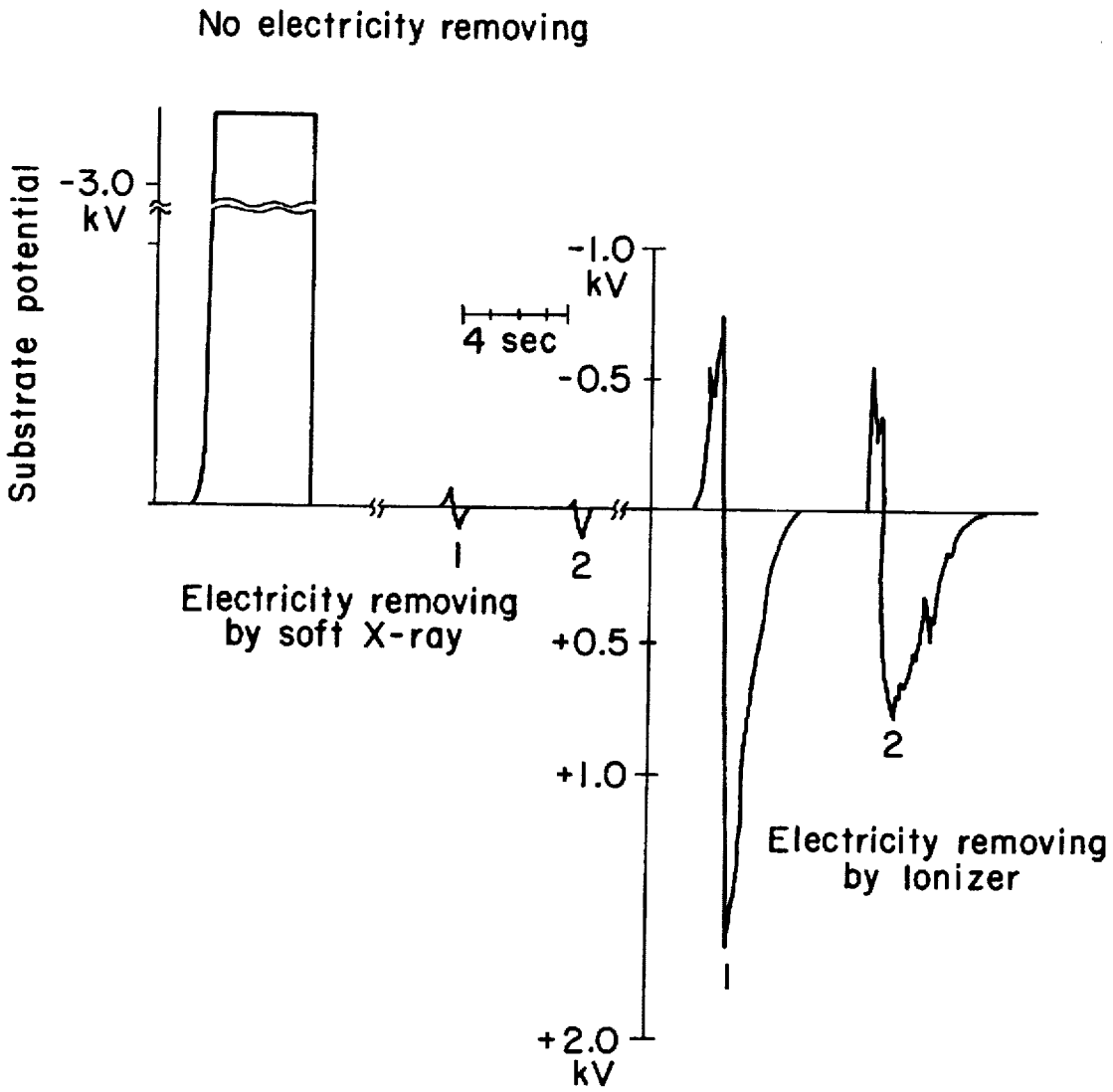
FIG. 20 illustrates a graph showing a change in surface potential of a glass substrate.

Next, FIG. 19 shows behavior of electricity removing in cleaning the glass substrate. When the substrate was pulled up from a tank after overflow-cleaning it by ultra purified water, the potential of the substrate reached −3.3 kV or more. FIG. 20 shows a result of measurement of the electricity removing characteristic in case wherein the electricity removing was performed simultaneously with the pulling-up. It was found that by the irradiation of the soft X-ray, the maximum electrification potential was restrained to 0.1 kV or less, the time period until it became 0 V was about 1 second, and the electrification could effectively be prevented.

By contrast, in case of using the ionizer, it reached 1.7 kV at maximum, and the electricity removing time period elapsed 4 through 5 seconds.

As stated above, even with the glass substrate, the electrified charge can completely be removed in a short time period and also the electrification can be prevented by the present invention.

It is possible to form positive and negative ions without being accompanied by dust generation by using the invented ion generating apparatus using the soft X-ray irradiation Further, in neutralizing electricity of an electrified object, it is possible to neutralize the charge of the electrified object in a short time period under any atmosphere, and the generation of static electricity can completely be prevented by applying this apparatus on an electrified portion.

This amounts to prevention of generation of defects by static electricity hazard and prevention of lowering the reliability of a product in manufacturing semiconductors or liquid crystals, which enhances the yield of a product. Especially, although there have been problems in adopting a wafer carrier of pure fluoroethylene resin system until now due to this problem of static electricity, such a concern has completely been eliminated by the application of this electricity removing method.

We claim:

1. A clean room having a ceiling and a floor and comprising means for providing a stream of clean air which flows down from the ceiling to the floor, an X-ray generator means for generating an electromagnetic wave in a soft X-ray region and for irradiating said stream of air substantially parallel with said ceiling to generate one of positive ions, negative ions, electrons, and a mixture of negative ions and electrons.

2. A transfer apparatus comprising a transfer chamber for transferring an object to be processed to a processing apparatus, an X-ray generator means disposed in said transfer chamber for generating an electromagnetic wave in a soft X-ray region and for irradiating atmospheric gas in said transfer chamber to generate one of positive ions, negative ions, electrons, and a mixture of negative ions and electrons.

3. The transfer apparatus according to claim 1, further comprising a load lock chamber interposed between the transfer chamber and a said processing apparatus, the X-ray generator means arranged such that the electromagnetic wave irradiates atmospheric gas in said load lock chamber.

4. The transfer apparatus according to claim 2, wherein the transfer chamber is formed from a material which is transparent with respect to the electromagnetic wave.

5. The transfer apparatus according to claim 4, wherein said transparent material is polyimide.

6. The transfer apparatus according to claim 2, wherein the transfer chamber is formed of stainless steel which has a thermal oxidation passive state film disposed on a surface thereof and which has an atomic ratio of Cr as compared with Fe of not less than 1, said transfer apparatus further comprising an incident opening in the transfer chamber for enabling irradiating said atmospheric gas with the electromagnetic wave in a soft X-ray region.

7. The transfer apparatus according to claim 6, further comprising a port extruding outwardly from said incident opening, the port having an end opening and a length so that an object to be processed in the transfer chamber is not visible from said end opening portion of the port, and a filter disposed in said port said filter made of a material transparent with respect to the electromagnetic wave in a soft X-ray region.

8. The transfer apparatus according to claim 2, wherein the apparatus floats and is adapted to transfer an object to be transferred by jetting a gas from a lower portion of the transfer chamber.

9. The transfer apparatus according to claim 8, wherein the gas jetting from the lower portion of the transfer clamber is nitrogen gas having an impurity concentration of several ppb or less, or air having a moisture concentration of several ppb or less.

10. A living chamber having an air introducing means for supplying a stream of air from outside to inside of the living chamber, means operatively associated with said chamber for forming one of positive ions, negative ions, electrons and a mixture of negative ions and electrons into said stream of air by irradiating an electromagnetic wave in a soft X-ray region to the air.

11. A plant cultivating chamber having an air introducing means for supplying a stream of air from outside to inside of the plant cultivating chamber, means operatively associated with said chamber for forming one of positive ions, negative ions, electrons, and a mixture thereof of negative ions and electrons into said stream of air by irradiating an electromagnetic wave in a soft X-ray region to the air.

12. A method for generating positive and negative charges employing X-ray irradiation comprising the step of applying an electromagnetic wave irradiation in a soft X-ray region to air under one of an enhanced pressure, an atmospheric pressure, and a reduced pressure, to form one of positive ions, negative ions, electrons and a a mixture of negative ions and electrons in the air.

13. A method of neutralizing electricity of an electrified object comprising the step of applying electromagnetic wave irradiation in a soft X-ray region to atmospheric air surrounding the electrified object, to ionize the atmospheric air and to form one of positive ions, negative ions, electrons, and a mixture thereof in the ionized atmospheric air, wherein a negative charge of a said electrified object is neutralized by positive ions, and a positive charge of a said electrified object is neutralized by negative ions, electrons or a mixture of negative ions and electrons.

14. The method of neutralizing electricity of an electrified object according to claim 13, wherein the electromagnetic wave in a soft X-ray region is a soft X-ray having a wavelength of 1 Å through several hundreds Å.

15. The method of neutralizing electricity of an electrified object according to claim 13, wherein the electromagnetic wave in a soft X-ray region is an electromagnetic wave generated by rendering a target voltage to 4 kV or more.

16. The method of neutralizing electricity of an electrified object according to claim 13, wherein the electromagnetic wave in a soft X-ray region is an electromagnetic wave generated by rendering a target current to 60 μA or more.

17. The method of neutralizing electricity of an electrified object according to claim 13, wherein the atmospheric air has a moisture concentration of several ppb or less.

18. The method of neutralizing electricity of an electrified object according to claim 13, wherein the atmospheric air has a pressure of 1 Torr through 1,000 Torr.

19. The method of neutralizing electricity of an electrified object according to claim 18, wherein the atmospheric air has a pressure of 20 Torr through 1,000 Torr.

20. An apparatus for neutralizing electrical charges of an electrified object, said apparatus comprising means for providing a stream of air at atmospheric pressure and for causing said stream to flow toward said object, and an X-ray generator means for generating X-rays in the soft X-ray region and for irradiating said stream of air to generate one of positive ions, negative ions, electrons, and a mixture of negative ions and electrons.

* * * * *

UNITED STATES PATENT AND TRADEMARK OFFICE

CERTIFICATE OF CORRECTION

PATENT NO. : 5,750,011

DATED : May 12, 1998

INVENTOR(S) : Tadahiro Ohmi, et al.

It is certified that error appears in the above-identified patent and that said Letters Patent is hereby corrected as shown below:

Claim 7, Col. 15, Line 21, delete "so" and insert --such--.
Claim 11, Col. 15, Line 47, after "mixture" delete "thereof".

Signed and Sealed this

Seventeenth Day of November, 1998

*Attest:*

*Attesting Officer*

BRUCE LEHMAN

*Commissioner of Patents and Trademarks*